US010548197B2

(12) United States Patent
Dau et al.

(10) Patent No.: US 10,548,197 B2
(45) Date of Patent: Jan. 28, 2020

(54) DIMMABLE LIGHTING DEVICES AND METHODS FOR DIMMING SAME

(71) Applicant: Quarkstar LLC, Las Vegas, NV (US)

(72) Inventors: Wilson Dau, Victoria (CA); George Lerman, Las Vegas, NV (US); Ferdinand Schinagl, North Vancouver (CA); Jacqueline Teng, Irvine, CA (US); Allan Brent York, Fort Langley (CA)

(73) Assignee: Quarkstar LLC, Las Vegas, NV (US)

( * ) Notice: Subject to any disclaimer, the term of this patent is extended or adjusted under 35 U.S.C. 154(b) by 0 days.

(21) Appl. No.: 15/912,460

(22) Filed: Mar. 5, 2018

(65) Prior Publication Data

US 2019/0053344 A1 Feb. 14, 2019

Related U.S. Application Data

(63) Continuation of application No. 15/156,127, filed on May 16, 2016, now Pat. No. 9,913,339, which is a (Continued)

(51) Int. Cl.
*H05B 33/08* (2006.01)
*H05B 37/02* (2006.01)

(52) U.S. Cl.
CPC ..... *H05B 33/0854* (2013.01); *H05B 33/089* (2013.01); *H05B 33/0845* (2013.01); *H05B 33/0848* (2013.01); *H05B 37/0281* (2013.01)

(58) Field of Classification Search
USPC ..... 315/209 R, 291, 307, 308, 312
See application file for complete search history.

(56) References Cited

U.S. PATENT DOCUMENTS 5,430,356 A 7/1995 Ference
6,292,901 B1 9/2001 Lys
(Continued)

FOREIGN PATENT DOCUMENTS

CA 2314163 A 6/1999
CN 101666960 A 3/2010
(Continued)

OTHER PUBLICATIONS

U.S. Appl. No. 15/156,127, filed May 16, 2016.
(Continued)

*Primary Examiner* — Jimmy T Vu
(74) *Attorney, Agent, or Firm* — Fish & Richardson P.C.

(57) ABSTRACT

In a single lighting device including a large number of light-emitting elements (LEEs), the LEEs are divided into separately powered groups, and different combinations of the groups are fully energized to achieve the desired overall brightness. In some embodiments, the number of LEEs in each group has a binary relationship to the other groups. The resolution of the dimming is the brightness of the smallest group. In one example of five binary weighted groups of LEEs, 32 brightness levels can be achieved while the LEEs in the energized groups are fully ON. Thus, since there is no high frequency switching, there is substantially no power dissipation by the dimming control system, and there is limited noise or EMI created. The dimming control can be easily implemented with a logic circuit controlling a transistor switch for each group.

9 Claims, 8 Drawing Sheets

Related U.S. Application Data continuation of application No. 14/684,910, filed on Apr. 13, 2015, now Pat. No. 9,345,092, which is a continuation of application No. 13/569,121, filed on Aug. 7, 2012, now Pat. No. 9,006,998.

(60) Provisional application No. 61/521,315, filed on Aug. 8, 2011.

(56) References Cited

U.S. PATENT DOCUMENTS

| | | | | |
|---|---|---|---|---|
| 7,768,212 | B2 | 8/2010 | Chen | |
| 7,777,427 | B2 | 8/2010 | Stalker | |
| 8,076,869 | B2 | 12/2011 | Shatford | |
| 8,587,212 | B2 | 11/2013 | Li | |
| 9,345,092 | B2 | 5/2016 | Dau et al. | |
| 2006/0273741 | A1 | 12/2006 | Stalker | |
| 2008/0218659 | A1 | 9/2008 | Kanaya et al. | |
| 2010/0007682 | A1 | 1/2010 | Kwon | |
| 2010/0052558 | A1* | 3/2010 | Lee | G09G 3/342 315/250 |
| 2010/0097002 | A1 | 4/2010 | Shatford et al. | |
| 2012/0038287 | A1* | 2/2012 | Li | H05B 33/0854 315/250 |

FOREIGN PATENT DOCUMENTS

| | | | |
|---|---|---|---|
| CN | 101755485 | A | 6/2010 |
| CN | 101785367 | A | 7/2010 |
| CN | 101990786 | A | 3/2011 |
| DE | 102007040111 | B3 | 10/2008 |
| JP | H0611364 | A | 2/1994 |
| JP | 2003100469 | A | 4/2003 |
| JP | 2005259426 | A | 9/2005 |
| JP | 2007207734 | A | 8/2007 |
| JP | 2007220855 | A | 8/2007 |
| JP | 2008216879 | A | 9/2008 |
| JP | 2009181839 | A | 8/2009 |
| WO | WO2008133792 | A2 | 11/2008 |
| WO | WO2009010916 | A3 | 3/2009 |
| WO | WO2009090511 | A3 | 11/2010 |
| WO | WO2010146519 | A1 | 12/2010 |
| WO | WO2011001392 | A2 | 1/2011 |

OTHER PUBLICATIONS

U.S. Appl. No. 14/684,910, filed Apr. 13, 2015.

U.S. Appl. No. 13/569,121, filed Aug. 7, 2012.

Muller, International Search Report in co-pending PCT application serial No. PCT/US2012/049874 dated Oct. 23, 2012 (11 Pages).

Japanese Application No. 2014-525099, Notice of Reasons for Rejection, dated Jun. 20, 2016, 17 pages.

Chinese Application No. 201510736949.2, Notification of First Office Action, dated Dec. 1, 2016.

Japanese Application No. 2016-247539, Notice of Reasons for Rejection, dated Sep. 15, 2017, 12 pages.

Japanese Patent Application No. 201510736949.2, Notification of the Third Office Action, dated May 16, 2018, 17 pages.

* cited by examiner

DIMMABLE LIGHTING DEVICES AND METHODS FOR DIMMING SAME

CROSS-REFERENCE TO RELATED APPLICATIONS

This application claims benefit of Provisional Patent Application No. 61/521,315, entitled "Dimmable Luminaire," and filed on Aug. 8, 2011, the entire contents of which is incorporated herein by reference.

TECHNICAL FIELD

The present technology relates to lighting control and, in particular, to methods for dimming lighting devices that include a plurality of light-emitting elements.

BACKGROUND

High-power LEDs that emit white light have become a choice for general solid-state lighting applications. Such high-power white LEDs have gained in brightness and can have luminous efficacies of 100 lm/W to beyond 200 lm/W. The input power of a contemporary single high-power LED is can be around 0.5 W to more than 10 W.

Such high-power LEDs can generate considerable amounts of heat while being only about 1 $mm^2$ in area and relatively thin, so the demands on the packaging can be challenging and expensive. Today, the cost for a bare high-power LED chip typically can be well under $1.00 (e.g., $0.10), yet the packaged LED may cost around $1.50-$3.00. This makes a high output (e.g., 3000+ lumens) solid-state lighting device relatively expensive and not a commercially feasible alternative for fluorescent light fixtures, for example, which are commonly used in office, industrial and other lighting applications. Further, the optics required to convert the high brightness point light sources into a substantially homogeneous, broad angle emission for space illumination where glare control is important, for example, in office lighting applications, is extremely challenging.

The amount of light generated by solid-state lighting devices can be controlled using pulse width modulation (PWM). In such a case either full or no power is supplied in form of pulses at high frequencies with variable pulse widths. The ratio of the pulse duration per pulse period, generally referred to as the duty cycle, determines the average amount of power per pulse period. In PWM control the amount of generated light depends on the duty cycle.

Drawbacks of PWM in SSL systems can include effects due to frequent switching of drive currents such as power losses in the control system and other components of the lighting device due to parasitic electromagnetic effects, audible noise and component fatigue due to mechanical stress from vibrations caused by electrostriction or other effects and/or electromagnetic interference (EMI) from electromagnetic radiation emitted from the system.

Therefore there is a need for a solution that overcomes at least one of the deficiencies in the art.

This background information is provided to reveal information believed by the applicant to be of possible relevance to the present technology. No admission is necessarily intended, nor should be construed, that any of the preceding information constitutes prior art against the present technology.

SUMMARY

An object of the present technology is to provide a dimmable lighting device. In accordance with an aspect of the present technology, there is provided a lighting device including multiple groups of light-emitting elements (LEEs), each of the groups of LEEs including one or more LEEs and configured to provide a nominal light output when energized under nominal operating conditions, the groups of LEEs independently energizable; and a controller operatively connected to the groups of LEEs and configured to determine a binary dimming code based on a dimming signal, the binary dimming code having multiple bits, each of the groups of LEEs associated with a corresponding bit of the dimming code, the controller further configured to energize each of the groups of LEEs based on a bit value of the corresponding bit of the dimming code.

In accordance with another aspect of the present technology, there is provided a method for controlling a light output of a lighting device including multiple groups of light-emitting elements (LEEs), each of the groups of LEEs configured to provide a nominal light output when energized under nominal operating conditions, the groups of LEEs independently energizable, the method including the steps of providing a binary dimming code having multiple bits; providing an association of each of the groups of LEEs with a corresponding bit of the dimming code; and energizing each of the groups of LEEs based on a bit value of the corresponding bit of the dimming code; whereby a light output of the lighting device corresponds with a superposition of light outputs of energized groups of LEEs.

In accordance with another aspect of the present technology, there is provided a method for configuring a dimmable lighting device; the method including providing the dimmable lighting device with multiple groups of light-emitting elements (LEEs), each of the groups of LEEs including one or more LEEs; configuring the groups of LEEs so they can be independently energized; providing a controller configured to determine a binary dimming code based on a dimming signal, the binary dimming code having multiple bits; configuring the controller with an association of each of the groups of LEEs with a corresponding bit of the dimming code; and configuring the controller to energize each of the groups of LEEs based on a bit value of the corresponding bit of the dimming code in correspondence with the association of each of the groups of LEEs with a corresponding bit of the dimming code; whereby the dimmable lighting device is configured to control light output of the lighting device via a controllable superposition of light outputs of energized groups of LEEs.

In certain implementations, the lighting device includes a homogenizer arranged to receive light from the groups of LEEs, the homogenizer configured to homogenize the light received from the groups of LEEs and to provide homogenized light, the homogenized light having a more homogenous appearance than the light received by the homogenizer from the groups of LEEs.

BRIEF DESCRIPTION OF THE DRAWINGS

The below described drawings are presented to illustrate various aspects of embodiments of the present technology.

DETAILED DESCRIPTION

Definitions

The term "light-emitting element" (LEE) is used to define any device that emits radiation in any region or combination of regions of the electromagnetic spectrum including the visible region, infrared and/or ultraviolet region, when activated by applying a potential difference across it or passing a current through it, for example. A light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or any other similar light-emitting devices as would be readily understood by a person skilled in the art. Furthermore, the term light-emitting element may be used to refer to the specific device that emits the radiation, for example a LED die, and/or refer to a combination of the specific device that emits the radiation together with a housing or package within which the specific device or devices are placed, for example, a LED package. Further examples of light emitting elements include lasers, specifically semiconductor lasers, such as VCSEL (vertical cavity surface emitting lasers) and edge emitting lasers. Further examples may include superluminescent diodes and other superluminescent devices.

The term "lighting device" is used to refer to a luminaire, fixture, fitting, lamp, bulb and other lighting devices configured to provide light for space illumination.

The term "light output" or illumination are used herein to refer to one or more aspects of the light provided by a lighting device, for example, an amount of light, chromaticity of light, radiant flux, luminous flux, light-emission pattern also referred to as or associated with a light-distribution pattern or photometric distribution, or other aspect of the light provided by the lighting device.

According to aspects of the present technology, there is provided a lighting device including multiple LEEs arranged into groups of LEEs, which can be separately energized/activated. It is noted that the terms energize and activate are used interchangeably herein and may refer to provision of full or partial power associated with a nominal operating condition. According to embodiments, the lighting device is configured to energize each of the groups of LEEs based on the bit value of a corresponding bit of a dimming code provided by a dimming signal. This may be referred to as "binary dimming." Each group of LEEs, when energized or activated may be either fully ON or OFF bit or be supplied with a portion of the power associated with a full ON operational condition.

Figure 1A:
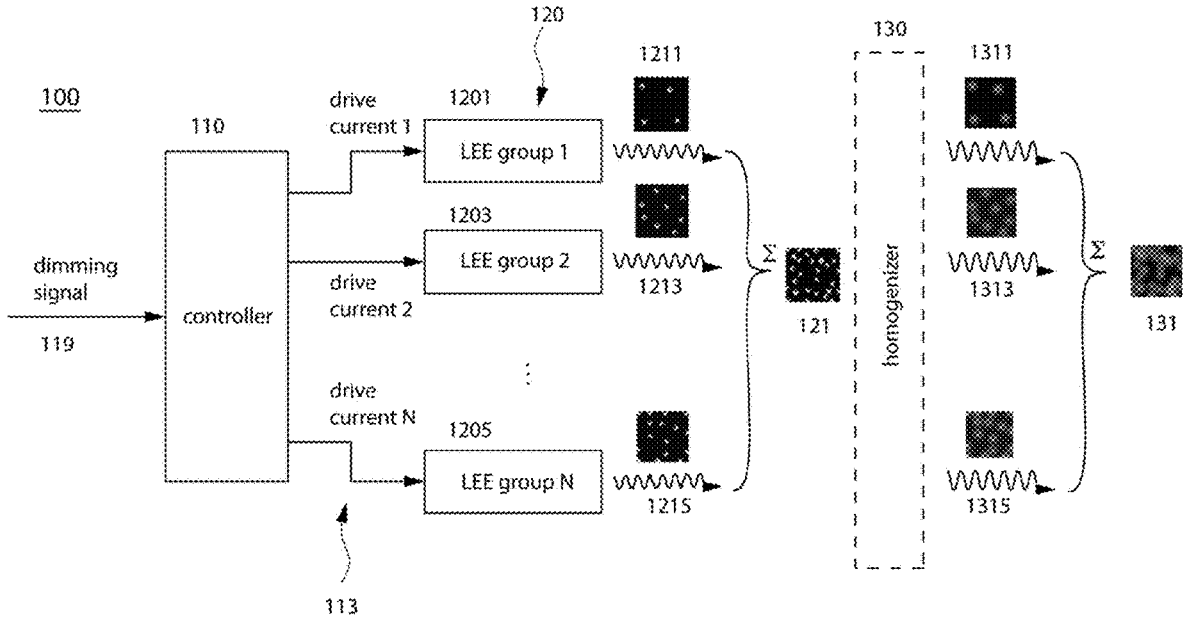
FIG. 1A illustrates a block diagram of a dimmable lighting device according to embodiments of the present technology.

FIG. 1A is a block diagram of a lighting device 100 according to embodiments of the present technology. The lighting device includes a controller 110, N (multiple) groups of LEEs 120 and optionally a homogenizer 130. The controller 110 is configured to receive a dimming signal 119 and to control N drive currents 113. Dimming signal 119 is produced by a signal generator (not shown) that interfaces directly or indirectly with a user. Signal generators can feature direct user interfaces (e.g., dimming switches) or indirect user interfaces (e.g., for wireless control). The controller 110 controls the drive currents 113 independently in combination with a source of power (not illustrated). The N groups of LEEs 120 are configured to be separately controllable from each other through separately controllable drive currents 113. Depending on the embodiment, such separate control may be fully independent or partially dependent considering parametric interrelations which may be caused, for example in embodiments that employ certain forms of feedback control based on signals obtained about sensed operational conditions of one or more components of the lighting device 100.

Depending on the embodiment, the dimming signal or a portion thereof, may be configured as an analog, digital or mixed analog/digital signal. Accordingly, the binary dimming code may be encoded, also being referred to as embedded, in the dimming signal in an analog, digital or mixed analog/digital fashion. Depending on the embodiment, the binary dimming code may correspond or form a portion of the dimming signal. Depending on the embodiment, the dimming signal may be provided via a wired and/or wireless interface of the lighting device. Depending on the embodiment, the binary dimming code may be encoded in a dimming signal that is further configured to provide power to the lighting device.

The LEEs in each of the groups of LEEs 120 can have various arrangements. Example arrangements of LEEs in three of the groups of LEEs are indicated by example luminance profiles 1211, 1213 to 1215. A superposition of the luminance profiles 1211, 1213 to 1215 is indicated by reference numeral 121. The example luminance profiles show four (1211), eight (1213) and 16 (1215) bright spots corresponding with the LEEs in respective groups of LEEs 120. Example luminance profiles as generated by a particular example homogenizer (not further specified) from light according to luminance profiles 1211, 1213 to 1215 are schematically illustrated in luminance profiles 1311, 1313, 1315 and 131. Luminance profile 1311 corresponds with luminance profile 1211, 1313 with 1213, 1315 with 1215 and 131 with 121. Again, it is noted that the illustrated luminance profiles are examples only and are not intended to indicate a particular function of the homogenizer 130 or limit the function of the homogenizer 130 thereto. The homogenizer 130 may be configured as or include a scattering diffuser, holographic diffuser, transparent substrate with one or more engineered surfaces, or other device for providing a homogenizing function as described herein. Depending on the embodiment, the homogenizer may be arranged and/or configured to homogenize a portion of the light from one or more of the groups of LEEs.

Figure 1B:
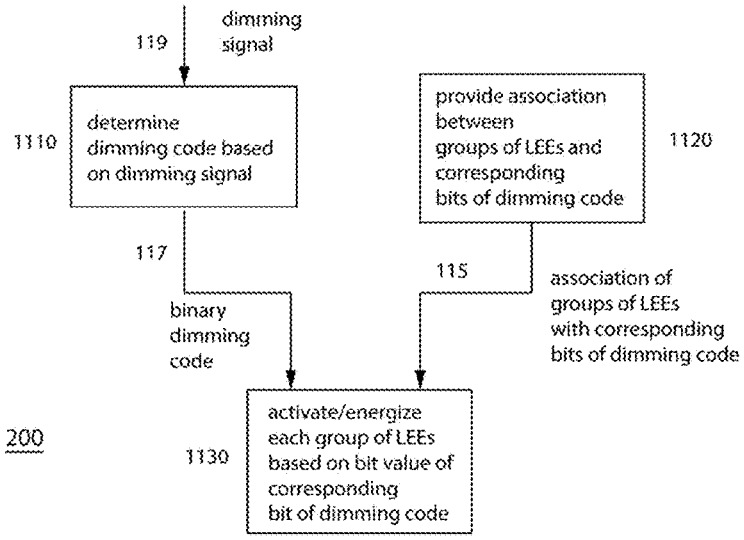
FIG. 1B illustrates a flow diagram of a method for dimming a lighting device as illustrated in FIG. 1A according to embodiments of the present technology.

Referring to FIG. 1B, a flow diagram of a method 200 for dimming the lighting device 100 as illustrated in FIG. 1A—also referred to as binary dimming as noted above. The method 200 may be implemented using controller 110 illustrated in FIG. 1A. Accordingly, the controller 110 is configured to determine the dimming code 117 based on the dimming signal 119 in step 1110. Depending on the embodiment and the configuration of the dimming signal 119, this step may include decoding the dimming signal and extracting the dimming code therefrom. Method 200, furthermore, provides an association 115 (i.e., a correspondence) between groups of LEEs and corresponding bits of the dimming code in step 1120. Such an association may be determined when the lighting device 100 is configured in combination with the configuration of a dimmer (not illustrated), such as a dimming switch, that generates the dimming signal. Depending on the embodiment, the binary dimming code 117 can be N or more bits long. If the binary dimming code includes more than N bits, a subset of N predetermined bits of the dimming code is sufficient to control the light output of the lighting device.

Figure 1C:
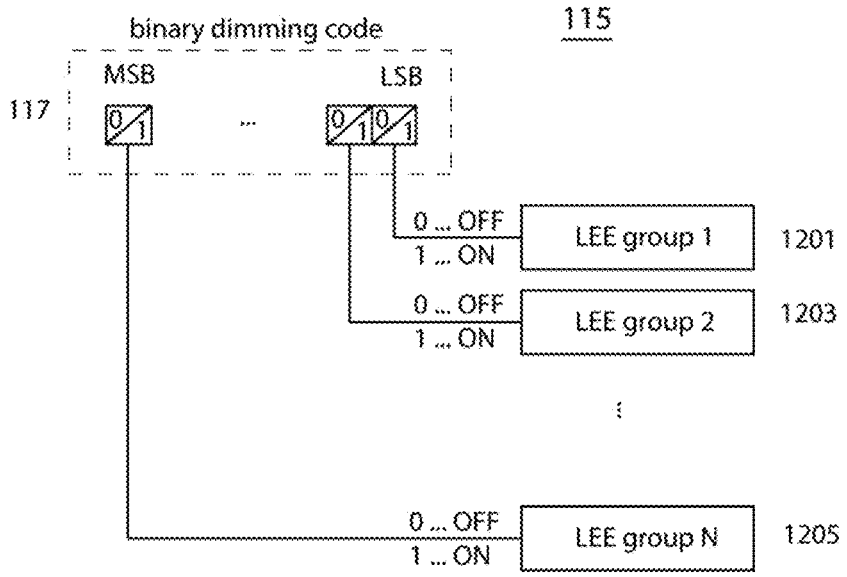
FIG. 1C illustrates an example association of bits of a binary dimming code with operational conditions of groups of LEEs in a lighting device according to the method illustrated in FIG. 1B.

Depending on the embodiment, the association may associate groups of LEEs by light output (per group) with the significance of bits in a predetermined order. Such order may be ascending, descending, a Grey code or another order, for example. Furthermore, the light output may refer to an associated amount of light, a light-distribution pattern, other aspect of the light output of the lighting device or combination thereof. The method 200 further includes step 1130 in which each group of LEEs is activated/energized based on the bit value of the corresponding bit of the dimming code. For example and as illustrated in FIG. 1C, group 1201 may be associated with the bit value of the least significant bit (LSB) of the binary dimming code 117, group 1203 may be associated with the bit value of the second least significant bit of the binary dimming code 117, and so forth, and group 1205 may be associated with the bit value of the most significant bit (MSB) of the dimming code 117. Each bit value may assume one of two possible values during operation, for example, "0" or "1". Generally and depending on the embodiment, controller 110 may be configured to activate/energize or deactivate/de-energize each group 120 if the corresponding bit value corresponds with "0" or "1", or vice versa. According to the example illustrated in FIG. 1C, each of the groups of LEEs is energized if the bit value of the corresponding bit is "1". As described herein, activation/energization may be in full or correspond with providing a portion of a nominal power associated with the corresponding group.

Depending on the embodiment, one or more groups may be selectively energized at a time in order to control, for example, how much light is generated by the lighting device. Variations of the amount of light provided by the lighting device may go hand in hand with variations of other properties of the emitted light. Such variations may include variations of chromaticity, light-emission pattern or other optical properties of the lighting device or the light emitted therefrom. Variations in effect of some form of control of the lighting device are generally referred to herein as dimming of the lighting device. A particular degree of dimming of the lighting device may be referred to as a dimming level, which may be encoded in a dimming signal. Groups may be selectively energized in a substantially static, transient, rapidly varying or other manner. Depending on the embodiment, a group may include one or more LEEs. Different groups may include equal or different numbers of LEEs.

Depending on the embodiment, selective energization of groups is accomplished by operating the LEEs with substantially direct currents (DC)—also referred to as linear dimming, pulse-width modulated (PWM), pulse-code modulated (PCM), other duty cycle controlled drive currents, other methods for controlling drive currents, or combinations thereof. Depending on the embodiment, magnitudes of one or more DC drive currents, which may also be referred to as amplitudes, may be controlled to assume two or more substantially static values to achieve nominally static operational conditions of the LEEs included in corresponding groups, for example when employing linear dimming.

Depending on the embodiment, linear dimming may be accomplished by providing discretely variable or substantially continuously variable DC drive currents (e.g., from controller 110). According to an embodiment, a discrete variation of drive currents includes providing either substantially zero or substantially full nominal drive currents to selectively activated groups of LEEs. Consequently, corresponding groups of LEEs may be referred to as fully ON or fully OFF. According to other embodiments, drive currents may be varied discretely, for example by providing either no, half nominal or full nominal (or three other magnitudes) of drive current to a groups of LEEs. Other discrete variations of drive currents may include zero, ⅓ nominal, ⅔ nominal and full nominal drive current (or four other magnitudes), for example. Further discrete variations may include smaller step variations including ¼, ⅕, ⅙, and so forth with corresponding numbers of different drive current magnitudes, for example. Such variations may be employed in DC and/or non-DC drive current control methods. It is noted that the magnitudes of the drive currents may be selected in accordance with a predetermined dimming function. Hence, differences between a pair of adjacent discrete drive current magnitudes may be different from another pair if the dimming function is non-linear, for example.

Depending on the embodiment, a lighting device may be dimmed without employing or by limiting employment of PWM, PCM or other alternating drive current schemes in the control of LEEs. Employment of such alternating drive current schemes may be limited to situations pertaining to certain operating conditions, for example, to compensate for deviations of certain operating conditions from their nominal values including variations in operating temperatures of the LEEs. It is noted that such deviations may be compensated for by other non-alternating drive current schemes including direct control of a DC drive current.

Depending on the embodiment, a lighting device may be dimmed by selectively activating one or more groups of LEEs at nominal or substantially nominal operating conditions while leaving one or more other groups of LEEs OFF at the same time. Depending on the embodiment, dimming of a lighting device may be achieved via a combination of selective activation of groups of LEEs and one or more forms of non-DC drive current control, including linear, PWM, PCM or other forms of non-DC drive current control. Consequently, certain effects of alternating drive currents including parasitic power dissipation, noise, mechanical stress and/or EMI generation in lighting devices and/or corresponding dimming control systems may be avoided and/or limited to certain operational conditions.

The present technology may be employed in combination with lighting devices that may include few as well as many light-emitting elements (LEEs). The LEEs may have one or more nominally equal or different optical, electrical, mechanical, thermal or other properties including chromaticity, brightness, efficacy, max drive current/voltage and/or other properties, for example. Depending on the embodiment, a lighting device may be configured with high-power LEEs, low-power LEEs, or a combination of high-power and low-power LEEs.

In certain embodiments, the LEEs of a lighting device are combined into a predetermined number of groups of LEEs. Different groups may include different or equal numbers of LEEs. The numbers of LEEs in the groups (sorted or unsorted) may then be referred to as the series of LEEs or simply the series. Depending on the embodiment, the series may be configured so that the lighting device can be dimmed to control the amount of light, the chromaticity of the light, the light-emission pattern or other optical property of the light provided by the lighting device. Groups may be configured to control one or more properties of the emitted light in accordance with a certain dimming function. Depending on the embodiment, configurations of groups may be characterized by the number of LEEs in the groups, the locations of the LEEs of the groups, predetermined nominal variations, if any, of the properties of the LEEs, or other characteristics. It is noted that the spatial arrangement of LEEs in a lighting device may be based on or be independent of the particular series of numbers of the LEEs per group and/or the number of groups per LEE.

Depending on the embodiment, a dimming function may specify brightness, chromaticity, light-emission pattern and/or other nominal properties of light to be emitted from a lighting device. For example, a dimming function may define brightness variations in a square-law manner similar to the dimming function 9 illustrated in FIG. 2. As is known, square-law dimming may be employed to provide the perception of a linear variation of the amount of light emitted from the lighting device to a human user. Depending on the embodiment, the numbers of LEEs per group may be configured to follow a series that may be determined based on a square-law or other predetermined dimming function. Depending on the embodiment, a dimming function may additionally, or instead of aspects relating to amount of light, including brightness, specify different chromaticity values and/or different light-emission patterns at different dimming levels.

Depending on the embodiment, selective activation of groups may be performed in a number of ways, for example, only one group may be activated at a time or one or more groups may be activated at a time. Depending on the embodiment, one or more groups of LEEs may be controlled independently of one or more other groups of LEEs. Depending on the embodiment, a lighting device may be configured to include one or more redundant LEEs and/or groups of LEEs. Such redundancies may be employed to achieve a desired appearance of a lighting device or the light emitted therefrom, or to balance operational loads among groups of LEEs, for example. Redundancies may be employed to limit and/or to equilibrate operating temperatures, drive currents, thermal gradients or other aspects relating to LEEs and/or groups of LEEs. Consequently, adequate control of redundant groups of LEEs with corresponding control systems can mitigate general and/or differential ageing of lighting device components and extend the lifetime of the lighting device. Depending on the embodiment, redundant groups of LEEs may be employed to aid in the homogenization of light provided by corresponding lighting devices as described herein. One or more redundant groups of LEEs may be optionally employed with an optional homogenizer as described herein.

As noted depending on the embodiment, groups of LEEs may be configured with certain numbers of LEEs based on a predetermined dimming function, to provide for a particular mode of controlling lighting levels and/or other aspects of the lighting device during dimming. Depending on the embodiment, a suitably configured controller may then be used to control selective activation of the groups based on a dimming level in combination with a predetermined feed forward and/or feedback control scheme to at least partially autonomously compensate for deviations of certain operating conditions from respective nominal values. Depending on the embodiment, configurations of groups of LEEs may further enable modes of control that inherently avoid flicker during dimming. For example, in embodiments that are configured to transition between dimming levels by changing operational conditions of only one group at a time in order for the lighting device to reach an adjacent dimming level, flicker can be substantially automatically avoided provided the transition is performed in a sufficiently well defined manner. Embodiments in which the transitions between adjacent dimming levels entails changing the operational condition of more than one group of LEEs, operational conditions of corresponding groups of LEEs can be ramped up and/or down in a controlled fashion during the transition and the transition be extended over an adequate duration.

According to some embodiments, flicker during dimming may be mitigated by adequately performing transitions of groups of LEEs when they undergo changes in operational conditions during dimming. For example, a control system of the lighting device may be configured to transition operational conditions of groups of LEEs that undergo such transitions in a substantially continuous fashion. This may be accomplished irrespective of whether groups of LEEs are provided with substantially DC or non-DC currents. For example, one or more DC drive current amplitudes may be ramped in a predetermined correlated manner from respective initial magnitudes to respective final magnitudes within a predetermined time period. Furthermore, a transition may be accomplished by temporarily superimposing one or more DC drive currents with suitably varying PWM, PCM or other alternating drive current modulations while suitably transitioning the respective DC drive currents.

Figure 2:
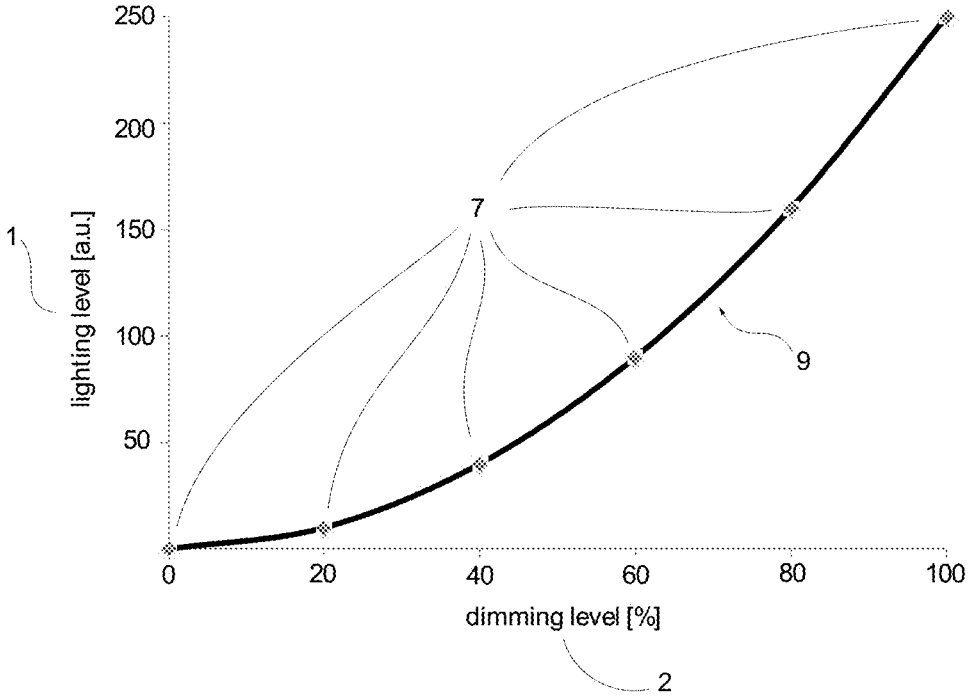
FIG. 2 illustrates an example square-law dimming function.

According to some embodiments, the numbers of LEEs in the groups are determined based on the quantized lighting levels of a predetermined dimming function. An example dimming function 9 is illustrated in FIG. 2, which shows the variation of a lighting level 1 with a corresponding dimming level 2. Such a dimming function may correspond with standard dimming functions as defined by a digital series interface (DSI), digital addressable lighting interface (DALI) or other standard or non-standard dimming functions, for example.

Depending on the embodiment, the numbers of LEEs per group may include quantized lighting levels, difference values between adjacent quantized lighting levels or other numbers that may be based on a predetermined dimming function. For purposes of determining numbers of LEEs per group, a dimming function may be quantized equidistantly or non-equidistantly at predetermined dimming levels or lighting levels. For example, the example square-law dimming function 9 may be quantized at equidistant dimming levels of 0%, 20%, 40%, 60%, 80% and 100% into five lighting levels 7 (excluding 0% dimming) corresponding with a series of 10, 40, 90, 160 and 250 predetermined lighting level units, for example. According to this example the dimming level is defined to increase with increasing lighting level but can be defined in an inverse or other fashion. A corresponding lighting device may then be configured to include groups with 10, 30, 50, 70 and 90 LEEs, wherein the last four numbers of LEEs are determined as the difference between adjacent pairs of the noted predetermined lighting level units. It is noted that one or more redundant groups with 10, 30, 50, 70 and 90 LEEs with equivalent relative relationships may be employed to achieve a desired appearance and/or an overall total lighting output of a corresponding lighting device based on the light output per LEE used therein.

Depending on the embodiment, groups may be configured with numbers of LEEs that are multiples or portions of a series of numbers. For example, for the above noted example a lighting device may include five groups with series of 5, 15, 25, 35 and 45 LEEs, or 20, 60, 100, 140 and 180 LEEs, or other derived series, respectively. Accordingly, the combined nominal light output of groups of a lighting device in which such groups are activated in an incremental manner can follow the same relative change in light output of the corresponding dimming function. This provides for a particular mode of controlling the lighting level provided by the lighting device during dimming. It is noted that the actual light output may be subject to thermal or other crosstalk or other effects, which may occur in the lighting device in effect of varying operating conditions. Depending on the embodiment, such effects may be mitigated by configuring the lighting device with adjusted series in which one or more numbers of a series of numbers may be modified to deviate from the series determined based on a dimming function alone. Furthermore, such effects may be mitigated by optionally considering such effects when controlling one or more of the drive currents via a correspondingly configured control system. Depending on the embodiment and subject to suitably stable environmental conditions, such effects may be compensated or mitigated with respect to certain dimming levels provided the lighting device is left to operate at a certain dimming level for an adequate amount of time. Such compensation may be provided in a feed forward control manner, for example, based on predetermined associations of the thermal characteristics of the particular lighting device for substantially constant operating conditions at one or more dimming levels.

According to some embodiments, the numbers of LEEs in the groups are arranged in a series of ascending numbers, for example, into five groups with 20, 40, 80, 160, and 320 LEEs. This may be referred to as a binary series since the number of LEEs doubles from one group to the next larger group. Such a grouping of LEEs can be employed for a dimming method according to the present technology that may be referred to as a binary group configuration as further described herein. A binary group configuration provides for particular modes of controlling the lighting level of a corresponding lighting device. Depending on the embodiment, substantially binary or other series of numbers of LEEs for the groups may be employed. Accordingly, lighting devices in which the numbers of LEEs in the groups follow a series of integer powers of two, or a multiple of such a series, the amount of light provided by the lighting device may be varied substantially in increments of the smallest of the light outputs provided by the groups of LEEs because of the combinatorial binary relationship inherent in the corresponding binary series of the number of LEEs per group although only one group may provide such a small number of LEEs. A lighting device with substantially equal LEEs that are arranged into groups wherein the number of LEEs adhere to a binary relationship may provide a high number of dimming levels with a low number of groups. Binary and other number series relationships enable particular control modes for selectively activating the groups to affect dimming of the lighting device as further described herein.

Depending on the embodiment, for various reasons, for example, in order to configure the lighting device to be able to provide a predetermined nominal maximum light output, to accommodate for effects in the light output of the LEEs in response to varying operating temperatures of the LEEs at various dimming levels, to achieve a predetermined variation of total light output with dimming level or for other reasons or to achieve other functions, the number of LEEs in the groups may be determined to follow a particular nominal series of numbers exactly or deviate therefrom. For example, for binary group configurations the numbers of LEEs in the groups may deviate from an exact binary series, that is one or more numbers of LEEs may deviate from an exact double of the number of LEEs of the next smaller or half of the next larger group.

According to some embodiments, the LEEs are arranged into groups so that the lighting device or one or more aspects of the illumination provided by the lighting device provide predetermined appearances at one or more dimming levels. Such appearances may be associated with homogeneity or variations of brightness or other properties of the light emitted by the lighting device as noted herein. Furthermore, such homogeneity may refer to far-field or near-field properties of the light provided by the lighting device. Appearance may refer to the lighting device itself when it is directly viewed and/or the illumination generated by the lighting device. Depending on the embodiment, a lighting device may appear or the illumination provided by the lighting device during operation may appear substantially homogenous or be characterized by one more types of spatial, angular or other variations. Depending on the embodiment, predetermined degrees of homogeneity may be achieved as described herein including employing an optional homogenizer in the lighting device, pseudo-randomly distributing the LEEs of one or more groups of LEEs in the lighting device, for example.

Depending on the embodiment, the LEEs of the lighting device may be arranged in a number of ways, for example, in substantially one or two-dimensional configurations, in one or more elongate, planar, spherical, or other configurations. The arrangement of the LEEs and the combination into groups may be configured to provide predetermined appearances at one or more dimming levels as noted above. According to some embodiments, LEEs may be arranged so that LEEs in at least one pair of adjacent and/or proximate LEEs belong to different groups. Such an arrangement may facilitate maintenance of a predetermined appearance of the lighting device and/or the illumination provided by the lighting device at one or more dimming levels.

Depending on the embodiment, groups of LEEs may be configured to provide light according to one or more photometric distributions. For example, one or more groups may be configured to provide one or more predetermined light-emission patterns such as an asymmetric horizontal or vertically differentiated illumination, which can be generated by selectively activating one or more of the groups of LEEs. This may be useful to vary the overall photometric distribution when the lighting device is dimmed and/or to improve efficacy of light utilization in certain applications of a correspondingly configured lighting device. For example, a lighting device for hallway lighting may be configured to lower the horizontal light illuminance when dimmed down because of light from adjacent offices while maintaining the vertical illuminance on adjacent walls for aesthetic purposes. Furthermore, light-emission patterns of light emitted at different dimming levels may be categorized by application, for example for office lighting during operating hours and/or closing hours, as well as for task lighting and/or mood lighting. Moreover, the light-emission patterns of light emitted at different dimming levels may be categorized by categories of operational conditions of staff occupying the illuminated space and/or the illuminated space itself with respect to emergency conditions and/or reduced power consumption. Indications of such and other operational conditions may be determined by the lighting device based on information about a nominal or reduced power level or other indication. Such an indication may be provided to the lighting device via the dimming signal or a separate externally provided signal or both. Depending on the embodiment, one or both of such signals may be provide via wireless or wired interfaces of the lighting device.

Depending on the embodiment, the lighting device may include LEDs arranged in one or more light sheets, light strings or other configurations and may include one or more optical systems and/or optical components, for example. Such configurations may include bare, packaged or other forms of LEDs and/or LED chips that are sandwiched between two or more substrates having conductors formed on one or more surfaces. The conductors on the substrates are configured to electrically operatively connect the LEDs, using traces, vias, wires or other conductors, for example. The conductors may connect two or more LEDs in series and/or parallel and are configured to provide an operative connection to a power source. According to some embodiments, a configuration may include up to several hundred or more LEEs. Such LEEs may provide up to a predetermined nominal amount of light. According to an embodiment, the LEEs may be configured for a nominal drive current of up to about 20 mA or higher where they generate small amounts of heat, which can be easily dissipated into ambient air.

A light sheet, light string or other configuration can be configured to provide a predetermined shape characterized by an extension into substantially one, two or three dimensions and can be formed using an array of interconnected narrow strips of LEEs, which may be connect in series, parallel, or a combination thereof, for example.

According to an embodiment, the number of LEEs in each group has a binary relationship to the other groups. An example lighting device may contain 620 low-power LEDs (for achieving the brightness of a conventional 2×4 foot fluorescent lighting device) configured into a first interconnected group of 20 LEDs, a second interconnected group of 40 LEDs, a third interconnected group of 80 LEDs, a fourth interconnected group of 160 LEDs, and a fifth interconnected group of 320 LEDs. The LEDs in each group may be randomly distributed within at least a portion of the lighting device. Each group is separately energizable. Depending on the embodiment, energization may occur by providing a full or a portion of a nominal maximum drive current. According to an embodiment, combinations of one or more of the groups may be fully energized by providing the full drive current or fully off. The brightness resolution of the example lighting device for dimming corresponds with the brightness of 20 LEDs. By using binary weighting of the number of LEDs in each group, 32 brightness levels can be achieved while the LEDs in the energized groups are fully on.

According to embodiments, a dimming control system is configured to selectively activate groups of LEEs as described herein. The dimming control system may be configured to control operational conditions of groups of LEEs in one or more predetermined manners including feed-forward, feedback or other manners, or combinations thereof. The dimming control system may be implemented in a logic circuit and configured to control drive current to each group, for example via a switch for each group. Such a switch may be configured as an ON/OFF or continuously variable switch, for example a suitably configured transistor switch. The dimming control system may be configured to control one or more drive currents in an ON/OFF, continuously variable, switching or other manner. Dimming is controlled via a dimming signal provided to the dimming control system that is configured to indicate a dimming level. The dimming signal may be generated at a lighting device or remotely and provided via a signal on a power line or other line, for example. A dimming signal may be adjusted via a slide, rotary, push button or other device. The dimming control system is configured to control the logic circuit to selectively actuate combinations of the switches that control the groups.

Figure 3:
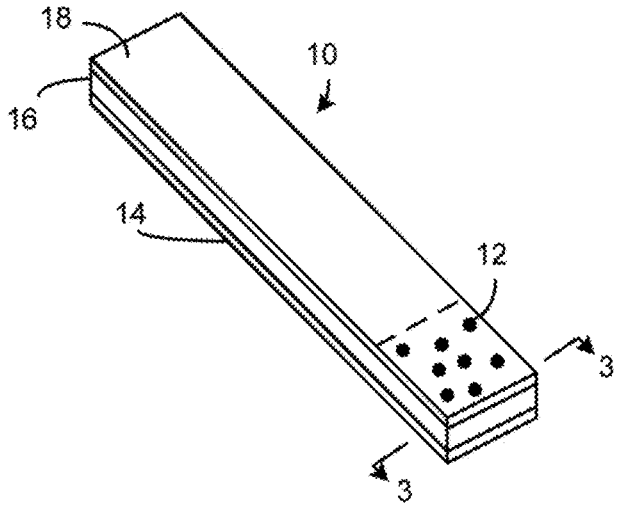
FIG. 3 illustrates a schematic perspective view of an example lighting device including a light sheet according to embodiments of the present technology.

FIG. 3 illustrates a perspective view of a portion of an example light sheet 10, schematically indicating locations of LEEs 12 (only the portion up to the dashed outline is shown) of a lighting device according to an embodiment. Depending on the embodiment, the LEEs 12 may be disposed in a predetermined pattern, for example, a pseudo-random, ordered or other pattern. A pseudo-random pattern may repeat across the light sheet 10 or the pseudo-random pattern may extend over the entire light sheet. Depending on the embodiment, the LEEs in one or more groups may be disposed around the lighting device so that the light output across the lighting device from each of the one or more groups provides a predetermined level of uniformity.

The example light sheet 10 may include up to 500 or more low-power LEEs configured to provide approximately 3700 lumens to replace a fluorescent fixture typically found in offices. Depending on the embodiment, the size of the light sheet may be up to about 2×2 feet, 2×4 feet or of another size. Depending on the embodiment, the sheet may include one or more planar or curved segments. Curvature of a curved segment may range from substantially flat to substantially curved with respect to the size of the lighting device. A curved segment may be spherical, elliptic, hyperbolic, parabolic or otherwise curved, for example.

According to some embodiments, the lighting device may include a plurality of narrow strips of serially connected LEEs supported on a single backplane. Depending on the embodiment, the backplane may be configured to electrically and/or mechanically interconnect the strips of LEEs into groups as described herein.

According to an embodiment, the light sheet 10 can be formed of three main layers: a transparent bottom substrate 14 having an electrode and conductor pattern; an intermediate sheet 16 acting as a spacer and optional reflector; and a transparent top substrate 18 having an electrode and conductor pattern. In one embodiment, the LEEs are electrically connected between electrodes on the bottom substrate 14 and electrodes on the top substrate 18. Depending on the embodiment, the light sheet 10 may have different thicknesses, for example, up to a few millimeters, and/or may be flexible.

Figure 4:
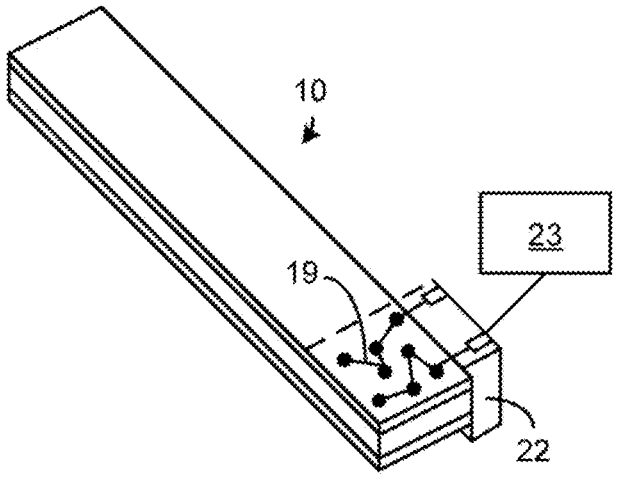
FIG. 4 illustrates a series connection of LEEs in the light sheet of FIG. 3 interconnected into groups of LEEs according to embodiments of the present technology.

FIG. 4 illustrates a sample pattern of conductors 19 on the top substrate 18 and/or bottom substrate 14 configured to connect two or more LEEs in series for a lighting device according to an embodiment. The two sets of series-connected LEEs may be connected in parallel (not illustrated). Parallel connections of the various serial strings of LEEs may be made internal or external to the light sheet. Depending on the embodiment, LEEs may be interconnected into series strings to maintain the drive voltage at or be below a predetermined level, for example, under 40 V. Keeping the drive voltage to a lower level, may simplify certain aspects of the lighting device design and may improve safety from electrical hazards.

Depending on the embodiment, series of LEEs may include other more complex combinations of serial and parallel-interconnected LEEs, for example, one or more series of parallel-interconnected series of LEEs. Depending on the embodiment, LEEs can be interconnected to allow the drive voltage and current to be selected during assembly and/or after manufacture, for example, during installation or servicing by a technician, user, customer or other person, or be customized to meet the requirements of a particular size of light sheet. Depending on the embodiment, two or more strings of LEEs may be interconnected in series, parallel, or a combination thereof for operative interconnection with a controller 22 providing different drive voltage, drive current and/or other characteristics.

The controller 22 is configured to supply power to various combinations of groups of LEEs to achieve dimming. Depending on the embodiment, power supply to the groups of LEEs may be substantially static except during a variation of the dimming level or unless otherwise dictated to maintain stability of the light output of the groups to compensate for flicker, drift, temperature variations or other parameters that may affect the operation of the LEEs. A DC or AC power supply 23 is shown connected to the controller 22. An input of the power supply 23 may be connected to the mains voltage. LEEs in one or more groups of LEEs may be series or otherwise connected into one or more strings or other configurations, so that the voltage drop across each LEE string is high enough to allow driving the series string of LEDs with a rectified mains voltage (e.g., 120 VAC) or other voltage.

Figure 5:
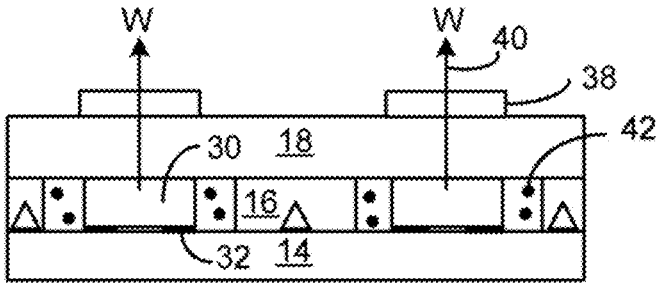
FIG. 5 illustrates a sectional view along line 3-3 of a variant of the light sheet illustrated in FIG. 3 based on flip chip LEEs.

FIG. 5 illustrates a cross section of the light sheet of FIG. 3 across line 3-3, where the LEEs 30 are LED flip chips, also referred to as horizontal LEDs or LED chips, with anode and cathode electrodes 32 on the bottom surface of the LEEs 30. The LEEs 30 are sandwiched between a top substrate 18 and a bottom substrate 14. Conductive traces on the bottom substrate 14 connect the LEEs 30 in series. A reflector layer may be formed on the bottom substrate 14. The LEEs in a group may be connected in series, parallel an/or one or more combinations thereof.

Depending on the embodiment, the LEEs 30 may be configured to emit blue light, in which case phosphor 38 may be deposited over the light path to convert all, or a portion, of the blue light to white light, as shown by the light rays 40. Phosphor 42 may also be incorporated into an encapsulant that fills the holes in the intermediate sheet 16 surrounding the LEEs 30.

Additional details of the various light sheets shown herein may be found in U.S. patent application Ser. No. 13/044,456, filed on Mar. 9, 2011, entitled, Manufacturing Methods for Solid State Light Sheet Or Strip With LEDs Connected In Series for General Illumination, by Louis Lerman et al., assigned to the present assignee and incorporated herein by reference.

Figure 6:
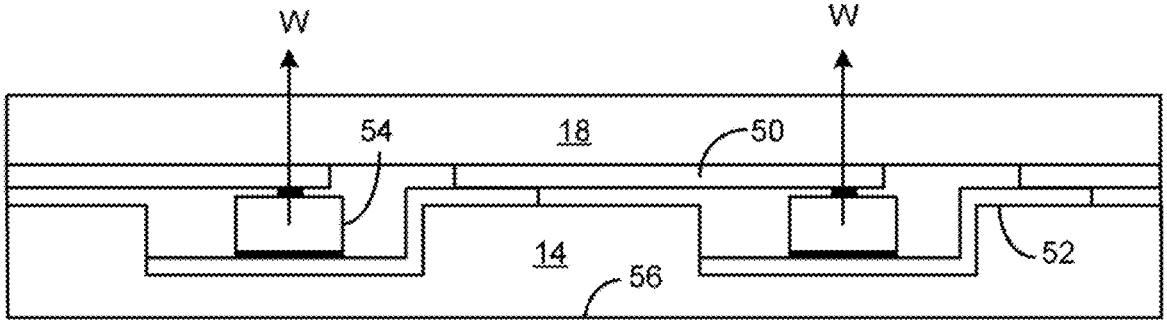
FIG. 6 illustrates a sectional view along line 3-3 of a variant of the light sheet illustrated in FIG. 3 based on vertical LEEs.
Figure 7:
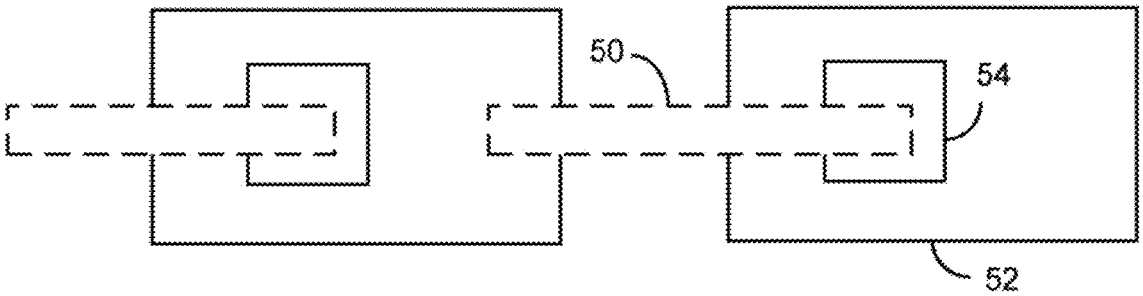
FIG. 7 illustrates another sectional view of the light sheet of FIG. 3 including the conductor connection in the light sheet between adjacent LEEs in a lighting device according to an embodiment.

FIG. 6 illustrates a portion of another embodiment of a light sheet, where the top substrate 18 and bottom substrate 14 have conductors 50 and 52 that overlap when the substrates are laminated together to form a series connection between LEEs 54. The LEEs 54 may be vertical LEDs with a top electrode, typically used for wire bonding, and a large reflective bottom electrode. A reflective layer 56 may be formed on the bottom substrate 14. FIG. 7 illustrates a top view of the portion of the light sheet of FIG. 6 showing the overlapping conductors 50 and 52 connecting the LEEs 54 in series.

According to some embodiments, the substrate electrodes disposed over the LEE anodes may by transparent conductors, such as ITO (indium-doped tin oxide) or ATO (antimony-doped tin oxide) layers, to avoid blocking light.

Depending on the embodiment, the light-emitting surface of the light sheet 10 may have lenses for controlling the light emission.

According to some embodiments, a single series string of LEEs is sandwiched between the substrates to form an LEE strip, where two of the LEEs in an LEE strip are shown in FIGS. 5 to 7. Each LEE strip includes a predetermined number of LEEs. For example, there may be 12 LEE chips in each LEE strip to keep the drive voltage under 40 V. The strips are then affixed to a supporting backplane and electrically interconnected by a conductor pattern or wires on the backplane. Any number of strips can be interconnected in a single group, such as in parallel, and there may be various groups made up of different numbers of LEE strips, as described in further detail below.

Figure 8:
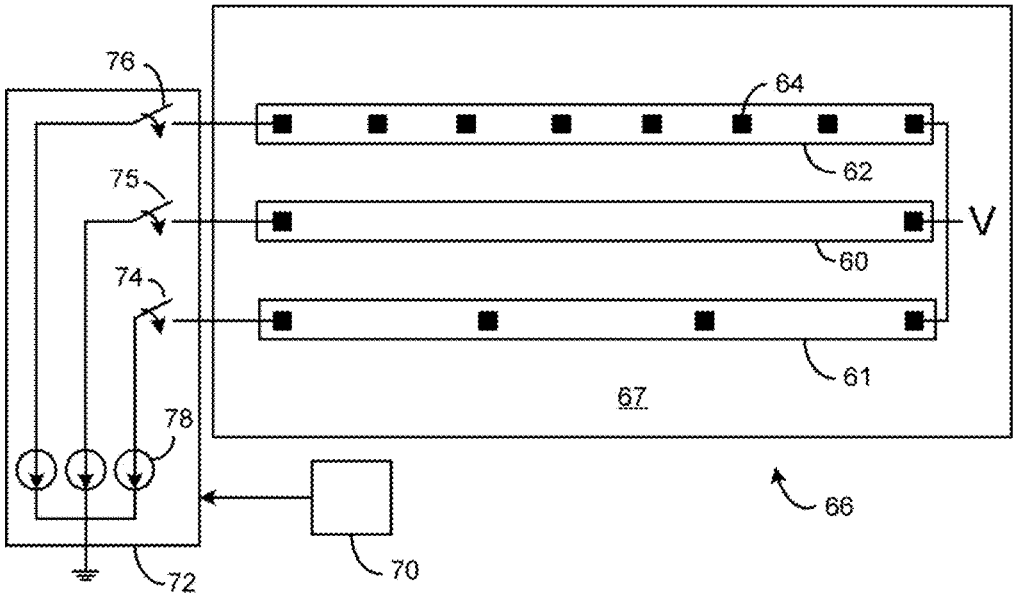
FIG. 8 illustrates a schematic circuit diagram of a lighting device according an embodiment.

FIG. 8 illustrates a schematic circuit diagram of a lighting device according to an embodiment, which includes a predetermined number of groups of LEEs that can be selectively energized. For illustration purposes, only three groups 60, 61, 62 of LEEs 64 are shown in a lighting device 66. There may be any number of groups. As illustrated, the number of LEEs in groups 60, 61 and 62 are binary weighted and include relatively small numbers of LEEs. Depending on the embodiment, larger numbers, even for the groups with the fewest LEEs may be chosen, in order to facilitate the provision of a predetermined homogenous lighting appearance. The first group 60 includes two LEEs 64, the second group 61 includes four LEEs 64, and the third group includes eight LEEs 64. Depending on the embodiment, a lighting device may include 620 LEEs in a single lighting device (e.g., as a replacement for a 2×4 foot troffer), in which the smallest group has 20 LEEs and there are five binary weighted groups having 40, 80, 160, and 320 LEEs, respectively. The lighting device 66 includes a reflective backplane 67 with traces and connectors configured to interconnect the strips in the groups.

Depending on the embodiment, the LEEs in a group may be interconnected in various ways, for example in series, in parallel and/or a combination thereof. For example, a group of 20 LEEs may be formed of two series strings of LEEs connected in parallel, where each string has 10 LEEs. Depending on the embodiment different groups may include different numbers of parallel-connected otherwise nominally equal strings of series-connected LEEs. For example, if there are N groups, the groups may include $m_1$, $m_2$, $m_3$ . . . $m_N$ parallel strings of M LEEs per string. If the numbers of LEEs per group are arranged in a binary fashion, there may be 1, 2, 4, 8 and so forth or other binary sequence of parallel strings per group. Furthermore, each group may have its own current source. Depending on the configuration and interconnection of the groups, the design of adequate current source(s) may be facilitated.

According to some embodiments, the number of LEEs per group, also referred to as the group size, is configured so that the lighting device provides a predetermined illumination level when the corresponding group is energized. Hence, the illumination levels of the groups may be configured to provide a predetermined, for example, an inverse square variation, a substantially binary or other variation of the illumination of the lighting device. It is noted that, even if nominally equal LEEs are employed in the groups, the relative group sizes may differ from the corresponding relative variations in illumination levels. For example, the group sizes may differ from exact binary ratios. This may be the case when thermal or other effects on components of the lighting device impact the overall efficacy of the lighting device when different numbers of LEEs are energized. It is further noted, that such thermal and/or other effects may be transient rather than instant, which may delay equilibration of the illumination provided by the lighting device in effect of a change in dimming.

Depending on the embodiment, one or more groups of LEEs may include nominally different LEEs and/or group sizes. Such group sizes may differ from, for example a binary series, in a predetermined manner. For example, 50% of the LEE population may provide a full 50% power reduction but because of the increased efficacy due to lower thermal loading when this group is switched off, the net light level may be reduced by 50% to 60% of the nominal maximum. Therefore, adequate choice of one or more group sizes can better approximate a predetermined variation of illumination levels. This effect may be emphasized in lighting devices that are subject to high levels of thermal cross-talk between different groups of LEEs.

Depending on the embodiment, a lighting device may be configured with groups of LEEs in combination with a suitable controller that allow fine granular dimming within one dimming range and coarser dimming within another dimming range. For example, the lighting device may be configured to allow fine granular dimming between 50% and 100% of its nominal illumination level. Such a lighting device may be useful in certain applications including office lighting or other applications, for example.

According to some embodiments, a lighting device may be used in combination with a remote signal generator 70 that can provide a dimming signal indicative of a desired level of dimming, also referred to as dimming level. The dimming signal may indicate a dimming level in increments of the smallest group of LEEs 64, which, in the case of FIG. 8, is the brightness of two LED chips 64. In other words, the signal generator 70 indicates one of eight dimming levels in increments of 12.5% (100/8=12.5). The signal generator 70 is configured to provide a 3-bit digital signal to a controller 72. Controller 72 includes a logic circuit that converts the 3-bit signal to control signals for transistor switches 74, 75, and 76, each connected to its own binary weighted current source 78, sized for the specific group. Other embodiments can have multiple current sources 78 for each group, depending on the current needs of the group. Depending on the embodiment, the signal generator 70 may be coupled to the controller 72 via mains wires powering the power supply 23 (FIG. 4), a separate control interface or other coupling, for example. The signal generator 70 may automatically generate a dimming signal in response to a programmed schedule and/or be configured to respond directly to manual user input. Consequently, in the steady state, the controller 72 requires little power and limited noise and/or EMI is generated. Depending on the embodiment, reproducibility of the dimming level may be better and efficacy of the dimmed system, particularly at low dimming levels, my be higher than in PWM controlled systems.

Depending on the embodiment, dimming of groups of LEEs may be achieved by a combination of ON/OFF switching of groups of LEEs with a variation of the amplitude of the DC drive current and/or voltage provided to the LEEs when ON. The variation of the amplitude of the DC drive current and/or voltage provided to the LEEs when ON may also be referred to as linear dimming. Such a combination of dimming methods may be employed, for example, to partially or fully interpolate dimming levels provided by selectively activating groups of LEEs as described herein, thereby providing finer control of the amount of light provided by a lighting device. Furthermore, a combination with linear dimming may enable use of smaller number of LEEs in the groups, also referred to as group sizes, while maintaining adherence to a predetermined variation of the illumination levels provided by the lighting device, achieve finer dimming, and/or maintain predetermined energy efficiency of the lighting device, for example.

According to an embodiment, a lighting device includes three groups of LEEs having seven LEEs and a controller configured to provide selective activation of the groups in combination with predetermined linear variation of the drive currents. A first group includes one LEE, a second group includes two LEEs and a third group includes three LEEs. Consequently, the illumination of the lighting device can be varied by no less than about 1/7 or approximately 14% of the nominal maximum illumination provided by the lighting device by selectively fully activating one or more of the groups of LEEs. Depending on the embodiment, the binary dimming levels may be interpolated by the controller to provide just enough variations in LEE drive currents that is roughly in proportion to the ratio of the desired dimming level difference between the binary step levels. Lighting device with small numbers of LEEs can be made smaller and/or use LEEs with higher light output while allowing drive currents to remain within a narrow operating ranges, which may facilitate design of the lighting device.

According to some embodiments, the lighting device is configured to provide control over the chromaticity of the LEEs in each group to allow the lighting device system to track a desired dimmed chromaticity pattern for aesthetic or user-driven purposes. Depending on the embodiment, this may be performed in combination with control of the overall amount of light emitted from the lighting device. Furthermore, the lighting device may be configured to respond to a dimming input in a manner similar to an incandescent lamp or other chromaticity variation. For example, the lighting device may be configured so that as the groups of LEEs are selectively energized the lighting device provides light ranging from a first chromaticity via a series of chromaticities to a second chromaticity.

Depending on the embodiment, multiple sets of binary groups of LEEs may be employed. Multiple sets may be employed to control optical asymmetry, chromaticity variation and other desired output properties simultaneously. Such sets may be electrically parallel connected. Accordingly, two or more binary groupings of LEEs may be employed that can be controlled by circuit logic capable of mapping a complex pattern of light distribution and chromaticity distributions in response to either input data or a predetermined mapping of light distribution and chromaticity variation to provide a desirable light output for a particular lighting application.

Figure 9A:
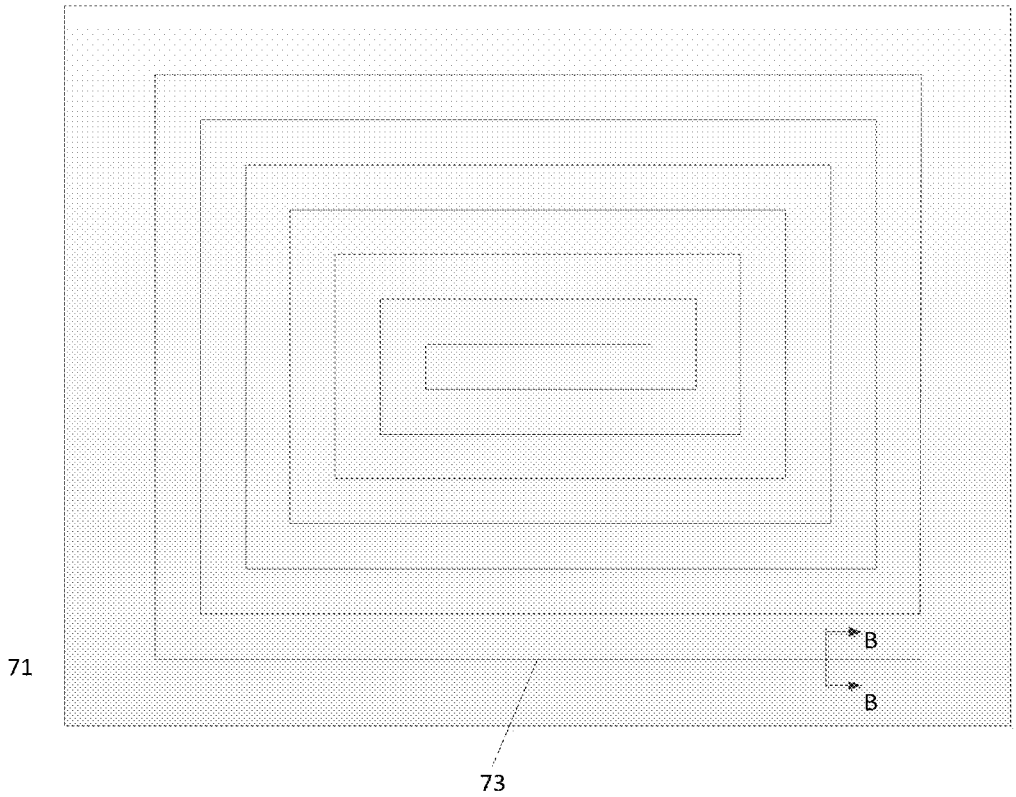
FIG. 9A schematically illustrates a top view of a light sheet including a spirally disposed example string of groups of LEEs for a lighting device according to an embodiment.
Figure 9B:
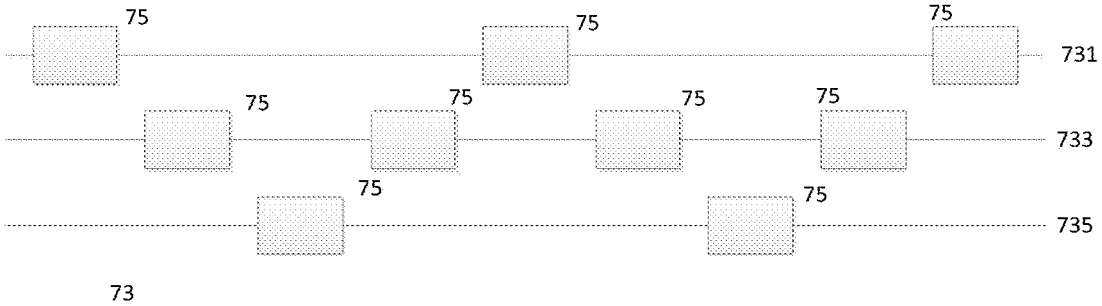
FIG. 9B schematically illustrates a detail of the example string of groups of LEEs illustrated in FIG. 9A across line B-B.

FIG. 9A schematically illustrates a top view of a light sheet 71 including a spirally disposed string 73 of groups of LEEs for a lighting device according to an embodiment in which the LEEs of the strings are interleaved in a specific regular configuration. It is noted, that the LEEs may be interleaved in other ways, for example pseudo randomly. FIG. 9B illustrates a detail of the string 73 of groups of LEEs illustrated in FIG. 9A across line B-B. The string 73 includes three groups of LEEs 731, 733, and 735, each of which includes a predetermined number of LEEs 75. In the example string 73, group 733 includes twice as many LEEs 75 as one of groups 731 and 735. It is noted that depending on the embodiment, different groups of LEEs may include different types of LEEs (not illustrated). Likewise, each of one or more groups may include different types of LEEs (not illustrated).

Figure 10:
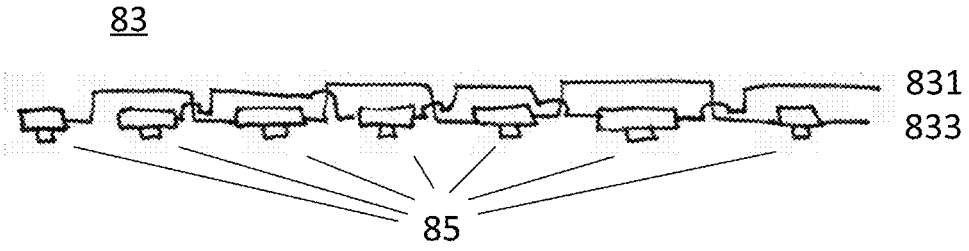
FIG. 10 illustrates a wiring diagram of an example string of two groups of LEEs for use in a lighting device according to an embodiment of the present technology.

FIG. 10 illustrates an example-wiring diagram for a string of LEEs 83 including two groups of LEEs 831 and 833. Each group 831 and 833 of the string of LEEs 83 includes like LEEs 85. The string is formed so that alternative LEEs belong to alternating groups 831 and 833, i.e. every second LEE 85 belongs to the same group. Depending on the embodiment, two or more adjacent LEEs may belong to the same group (not illustrated). Moreover, more than two groups of LEEs may be disposed and wired in a manner similar to that of FIG. 10. Such a string may be formed in one or more ways, for example, by arranging and operatively interconnecting a first subset of LEEs associated with a first group followed by a subset of LEEs associated with a second group, followed by a subset of LEEs associated with a third group and so on until the last group has been reached and then going back to the first group until all LEEs of all groups are disposed. It is further noted that strings of LEEs in other embodiments may include different LEEs in different groups and/or within a group. Strings of LEEs in lighting devices according to other embodiments may be interconnected in different manners.

According to some embodiments, groups of LEEs may be configured for operative disposition in a lighting device comprising one or more light guides, which are configured to guide light provided by the LEEs under operating conditions to a predetermined location for further manipulation and/or emission from the lighting device. Light guides, optical and other forms of operative coupling between the light guides and groups of LEEs of such lighting devices may be configured in one or more ways, depending on the embodiment. Examples thereof are illustrated in FIGS. 11A to 13B.

Figure 11A:
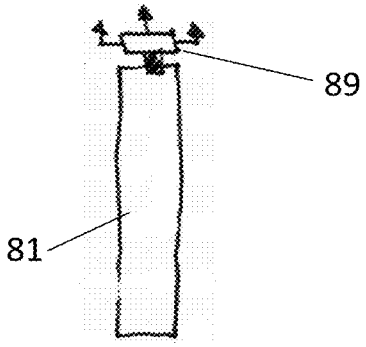
FIG. 11A illustrates a sectional view of components of an example lighting device including a string of groups of LEEs operatively disposed on a substrate and coupled with an edge of an example light guide according to an embodiment of the present technology.
Figure 11B:
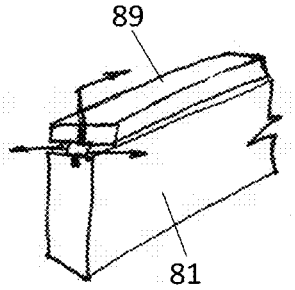
FIG. 11B illustrates a perspective view of the components of the example lighting device illustrated in FIG. 11A.

FIG. 11A illustrates a cross section of components of an example lighting device including a string of LEEs operatively disposed on a substrate 89 and coupled with an edge of a light guide 81 according to an embodiment of the present technology. FIG. 11B illustrates a perspective view of the components of the example lighting device illustrated in FIG. 11A.

Figure 12A:
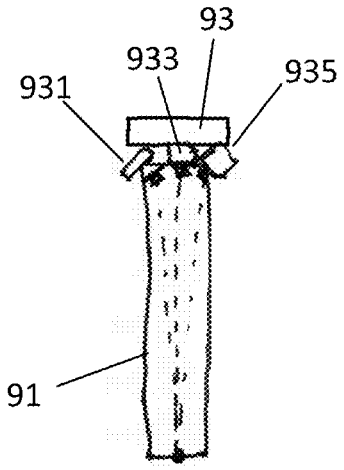
FIG. 12A illustrates a sectional view of components of another example lighting device including three strings of groups of LEEs operatively coupled with one or more edges of an example light guide according to an embodiment of the present technology.
Figure 12B:
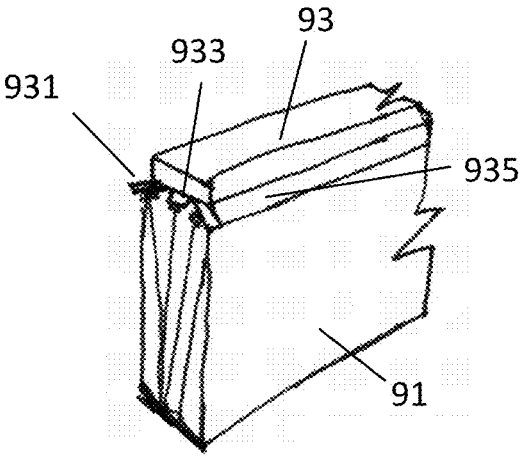
FIG. 12B illustrates a perspective view of the components of the example lighting device illustrated in FIG. 12A.

FIG. 12A illustrates a cross section of components of another example lighting device including three strings 931, 933, and 935 of groups of LEEs operatively connected via a substrate 93 and optically coupled with one or more edges of a light guide 91 according to an embodiment of the present technology. FIG. 12B illustrates a perspective view of the components of the example lighting device illustrated in FIG. 12A. FIGS. 12A and 12B include indications of the optical paths of light from the LEEs within the light guide 91.

Figure 13A:
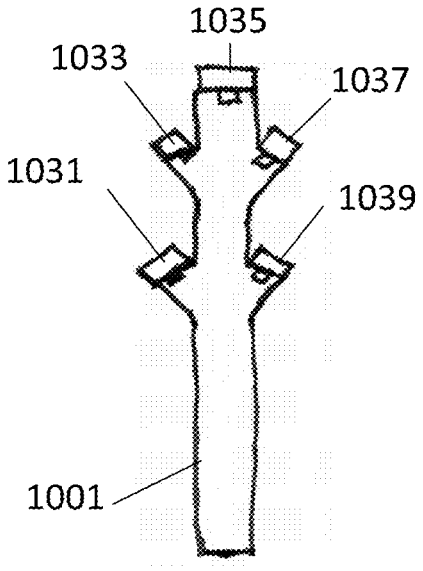
FIG. 13A illustrates a sectional view of components of another example lighting device including five strings of groups of LEEs operatively coupled with five edges of an example light guide according to an embodiment of the present technology.
Figure 13B:
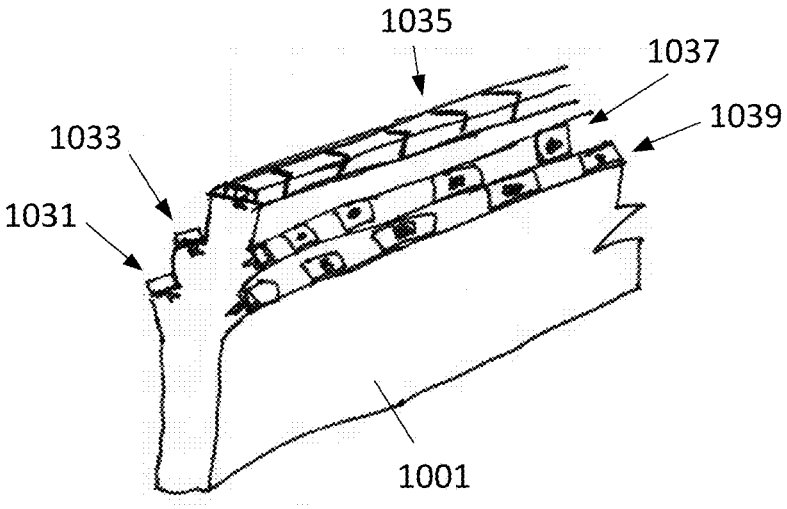
FIG. 13B illustrates a perspective view of the components of the example lighting device illustrated in FIG. 13A.

FIG. 13A illustrates a cross section of components of another example lighting device according to an embodiment of the present technology including five strings 1031, 1033, 1035, 1037, and 1039 of groups of LEEs suitably operatively interconnected via corresponding substrates. The LEEs of the strings 1031, 1033, 1035, 1037, and 1039 are optically coupled with five edges of an example light guide 1001. The example lighting device may be configured to provide a direct line of sight for and/or guidance of predetermined portions of light provided by one or more of the strings 1031, 1033, 1035, 1037, and 1039 to the bottom edge of the light guide 1001. FIG. 13B illustrates a perspective view of the components of the example lighting device illustrated in FIG. 13A.

The present technology may be employed in lighting devices including a plurality of LEEs ranging from both small to relatively large numbers of LEEs, so that the devices can be divided up into various sized groups that can be selective energized in order to control the amount of light emitted by the lighting device.

The various features of all embodiments may be combined in any combination.

While particular embodiments of the present technology have been shown and described, it will be obvious to those skilled in the art that changes and modifications may be made without departing from this technology in its broader aspects and, therefore, the appended claims are to encompass within their scope all changes and modifications that fall within the true spirit and scope of the technology.

We claim:

1. A lighting device comprising:

multiple groups of light-emitting elements (LEEs), the groups being independently energizable, each of the groups comprising one or more LEEs, the groups configured to provide different amounts of light when energized, a first one of the groups configured to provide a smallest amount of light of all the groups, each one of the groups except the first group providing twice an amount of light of another group, wherein, in each of the groups, the number of LEEs is an integer power of two scaled by a factor which is the same for all the groups; and a controller operatively connected to the multiple groups and configured to determine a binary dimming code based on a received dimming signal, the binary dimming code having multiple bits, each of the groups of LEEs associated with exactly one bit of the dimming code, the controller further configured to energize each of the groups of LEEs when a corresponding bit of the dimming code has a predetermined bit value.

2. The lighting device of claim 1, wherein the predetermined bit value is "1".

3. The lighting device of claim 1, wherein the numbers of LEEs in the groups are integer powers of two.

4. The lighting device of claim 1, wherein light output by each group corresponds to a difference in light outputs of the lighting device between adjacent dimming levels of the lighting device.

5. A lighting device comprising:

multiple groups of light-emitting elements (LEEs), the groups being independently energizable, each of the groups comprising one or more LEEs, the groups configured to provide different amounts of light when energized, a first one of the groups configured to provide a smallest amount of light of all the groups, each one of the groups except the first group providing twice an amount of light of another group;

a controller operatively connected to the multiple groups and configured to determine a binary dimming code based on a received dimming signal, the binary dimming code having multiple bits, each of the groups of LEEs associated with exactly one bit of the dimming code, the controller further configured to energize each of the groups of LEEs when a corresponding bit of the dimming code has a predetermined bit value; and a homogenizer arranged to receive light from the groups of LEEs, the homogenizer configured to homogenize the light received from the groups of LEEs and to provide homogenized light, the homogenized light having a more homogenous appearance than the light received by the homogenizer from the groups of LEEs.

6. The lighting device of claim 5, wherein the LEEs in one or more of the groups of LEEs are arranged pseudo randomly.

7. A lighting device comprising:

multiple groups of light-emitting elements (LEEs), the groups being independently energizable, each of the groups comprising one or more LEEs, the groups configured to provide different amounts of light when energized, a first one of the groups configured to provide a smallest amount of light of all the groups, each one of the groups except the first group providing twice an amount of light of another group; and a controller operatively connected to the multiple groups and configured to determine a binary dimming code based on a received dimming signal, the binary dimming code having multiple bits, each of the groups of LEEs associated with exactly one bit of the dimming code, the controller further configured to energize each of the groups of LEEs when a corresponding bit of the dimming code has a predetermined bit value, wherein the LEEs are arranged to provide one or more of the nominal light outputs of the groups of LEEs with a first light-emission pattern and one or more of the nominal light outputs of the groups of LEEs with a second light-emission pattern different from the first light-emission pattern.

8. The lighting device according to claim 7, wherein the first light-emission pattern is configured to provide illumination of an office space during operating hours and the second light-emission pattern is configured to provide illumination of the office space during closing hours.

9. The lighting device according to claim 7, wherein the first light-emission pattern is configured to provide illumination of a space for task lighting and the second light-emission pattern is configured to provide illumination of the space for mood lighting.

* * * * *